United States Patent [19]

Ashworth

[11] Patent Number: 5,012,586

[45] Date of Patent: May 7, 1991

[54] PLOTTING AND DRAFTING APPARATUS WITH MAGNETIC GUIDE

[76] Inventor: Anthony J. Ashworth, 2-1545 Marine Drive, West Vancouver, Canada, V7V 1H9

[21] Appl. No.: 399,575

[22] Filed: Aug. 28, 1989

[51] Int. Cl.[5] ..... B43L 12/02

[52] U.S. Cl. ..... 33/430; 33/431; 33/435; 33/DIG. 1; 335/285

[58] Field of Search ..... 33/DIG. 1, 430–438; 335/285–287

[56] References Cited

U.S. PATENT DOCUMENTS

| | | | |
|---|---|---|---|
| 3,618,137 | 11/1971 | Bassett | 335/285 |
| 3,672,062 | 6/1972 | Baker | 33/109 |
| 3,746,992 | 7/1973 | Serembe | 335/285 |
| 3,835,542 | 9/1974 | DeMathe | 33/109 |
| 3,908,274 | 9/1975 | Gerry | 33/431 |
| 4,653,194 | 3/1987 | Kim | 33/429 |
| 4,854,049 | 8/1989 | Kuhtik | 33/DIG. 1 |

FOREIGN PATENT DOCUMENTS

| | | | |
|---|---|---|---|
| 2902668 | 8/1979 | Fed. Rep. of Germany | 33/430 |
| 0165702 | 10/1982 | Japan | 33/DIG. 1 |
| 8705863 | 10/1987 | United Kingdom | 33/438 |

OTHER PUBLICATIONS

Ultra Mag Product Information Sheet Magnets Inc. 1140 Deerfield Road, Cincinnati, Ohio, (no date).

45242 U.S.A./Ultra Mag Plus Advertising Sheet Magnets Inc. 1140 Dearfield Road, Cincinnati, Ohio, (no date).

45242 U.S.A./Ultra Mag Magnetic Extrusions Product Information Sheet, Magnets Inc. 1140 Dearfield Road, Cincinnati, Ohio, (no date).

Ultra Mag Facts Sheet, Magnets Inc., 1140 Dearfield Road, Cincinnati, Ohio 45242 U.S.A., (no date).

*Primary Examiner*—William A. Cuchlinski, Jr.
*Assistant Examiner*—Alvin Wirthlin

[57] ABSTRACT

A plotting and drafting apparatus comprises a drawing implement having a body, a rule portion and a device for connecting the rule portion to the body. The body has a first surface and a first generating device for generating a first series of juxtaposed parallel linear magnetic poles in the first surface. The poles of the first series extend linearly in a first direction of parallelism with adjacent poles being spaced apart laterally from each other in a first direction normal to the first direction of parallelism. The rule portion has a datum edge disposed at an angle relative to the first direction of parallelism. The apparatus further includes a supporting device having a second surface for supporting the drawing implement and has a second generating device for generating a second series of juxtaposed parallel linear magnetic poles in the second surface. The poles of the second series extend linearly in a second direction of parallelism with adjacent poles being spaced apart laterally from each other in a second direction normal to the second direction of parallelism. The magnetic attraction between the poles of the first series associated with the drawing implement and the poles of the second series associated with the supporting device retains the drawing implement in alignment and on the second surface.

24 Claims, 7 Drawing Sheets

PLOTTING AND DRAFTING APPARATUS WITH MAGNETIC GUIDE

BACKGROUND OF THE INVENTION

The invention relates to a plotting and drafting apparatus having a magnetic guide for maintaining the orientation of a drawing implement on a surface.

For many years it has been known to use a T-square for drawing parallel lines on a drawing, etc. Typically, the drawing is fastened to a drafting board and the T-square has a guide edge which rests upon a straight side edge of the drafting board. The T-square has a straight datum edge extending perpendicularly to the guide edge. The guide edge rides on the straight side edge of the drafting board and is used to guide movement of the T-square in order to maintain the T-square and datum edge in a desired orientation relative to the drafting board. This permits a draftsman to draw parallel lines or to position other instruments. T-square must be used on a board or table having a straight side edge, and furthermore forces applied to the T-square, particularly to an outer end of the datum edge of the T-square, can deflect the T-square from normal alignment. Such forces might be applied, for example, when drawing lines, and therefore, lines drawn adjacent the outer end of the T-square may not be parallel or aligned with lines adjacent an inner end of the T-square. The T-square can therefore lead to inaccurate unparallel lines.

Drafting can also be done using a drafting board with an attached drafting machine. Typically, a drafting machine is fastened to a portion of the drafting board and uses a mechanical arrangement of tracks, endless loops and pulleys, etc. to guide a drawing implement with a datum edge across a surface of the drafting board with great accuracy. Such a machine enables a draftsman to draw parallel lines relatively easily. In addition, drafting machines typically have a drafting head which often has one or more straight edges pivotally mounted thereto. The straight edges can be pivoted to permit the draftsman to draw a line at any angle relative to the horizontal and vertical dimensions of the drafting board. Drafting machines and drafting heads however, require precise machining and can be expensive.

U.S. Pat. No. 3,672,062 describes an apparatus designed to overcome some of the disadvantages with early drafting equipment by using a magnetic roller on a ferrous surface of a drafting board. Magnets in the roller attempt to eliminate relative skidding between two ends of the roller and the board and tend to maintain the roller in alignment. Thus, the roller may be drawn across the surface with minimal slippage against the surface and therefore, tracking of the roller is relatively accurate. It would appear that in order to draw parallel lines on a drawing, it is imperative that the roller not be removed from the drawing. Should the roller be removed, it becomes necessary to re-align the roller on the surface. Thus, it can be difficult to re-establish proper placement of the roller in order to draw parallel lines. Thus, the alignment of the drawing implement depends upon the placement of the magnetic roller on the drafting board.

Besides their uses in drafting, drawing implements such as parallel rulers are used in navigation to transfer bearing and course headings from one portion of a nautical chart to another. Parallel rulers have two parallel rulers each having respective straight edges and being connected to each other by cross-members. The cross-members are pivotal with respect to each ruler and therefore by moving one ruler parallel to the other, the cross-members are rotated and the rulers are further spaced apart or brought closer together while maintaining the respective straight edges parallel at all times.

Usually parallel rulers are used by aligning the straight edge on the first ruler with a particular course heading, holding the first ruler firmly on the chart, and the moving second ruler away from the first ruler. The second ruler is then held firmly on the chart and the first ruler is brought close to the second ruler by the pivotal action of the cross-members. Then, the first ruler is held firmly on the chart and the second ruler is moved away from the first ruler again. This process is referred to as "walking" the rulers across the chart and is used to transfer selected course headings to any portion of the chart.

Parallel rulers are limited in transferring bearings accurately from relatively widely spaced apart positions on the chart due to the limited degree of spacing of the edges of the parallel rulers as limited by the connecting cross-members extending between the rulers. In addition, as the rulers are walked over the chart, slippage can inadvertently occur between the rulers and the chart and introduce an error into the transferred heading. Furthermore, there is a chance of the rulers inadvertently slipping upon taking each "step", and therefore the degree of error in the transferred heading is cumulative. Consequently parallel rulers can result in erroneous headings.

With any of the above-mentioned devices it is sometimes necessary to remove the drawing implement from the drafting board or chart in order to re-position paper or to observe the drawing or chart on which the drawing implement is being used. In addition, it is desirable to maintain alignment of the drawing implement on the surface of the drafting board and it would be of great advantage to be able to draft on a table or flat surface other than a drafting board. Furthermore, it is desirable to reduce the number of moving parts in the alignment mechanism of the drawing implement in order to reduce alignment problems associated with wear, tensioning, slippage, friction, etc. associated with those parts.

SUMMARY OF THE INVENTION

The present invention reduces the problems associated with the prior art by providing a mechanically simple plotting and drafting apparatus comprising a drawing implement having a body, a rule portion and connecting means for connecting the rule portion to the body. The body has a first surface and first generating means for generating a first series of juxtaposed parallel linear magnetic poles in the first surface. The poles of the first series extend linearly in a first direction of parallelism with adjacent poles being spaced apart laterally from each other in a first normal direction normal to the first direction of parallelism. The rule portion has a datum edge disposed at an angle relative to the first direction of parallelism. The apparatus further includes supporting means having a second surface for supporting the drawing implement and second generating means for generating a second series of juxtaposed parallel linear magnetic poles in the second surface. The poles of the second series extend in a second direction of parallelism with adjacent poles being spaced apart laterally from each other in a second normal direction normal to the second direction of parallelism. The magnetic attraction between the poles associated with the drawing implement and the poles associated with the supporting means maintain the drawing implement in alignment and on the second surface.

The apparatus enables a draftsman to work on drawings or charts on tables or flat surfaces not having a straight edge. Furthermore, the supporting means is flexible and can be rolled up for storage. To use the device, the draftsman simply unrolls the supporting device, secures the drawing or chart thereto and places the drawing implement thereon. The drawing implement and the supporting device use the magnetic forces of the first and second series of magnetic fields to retain the drawing implement on the supporting device and to maintain alignment of the drawing implement. The juxtaposed linear parallelism of the magnetic poles aligns the first and second series of magnetic poles such that the first direction of parallelism is parallel with the second direction of parallelism The linear nature of the poles permits the drawing implement to slide across the supporting device in a direction parallel to the second direction of parallelism but resists movement in any other direction. Thus, the drawing implement may simply be placed on the supporting device anywhere on the second surface and it will be automatically aligned to permit drawing of parallel lines. The drawing implement can be re-positioned simply by sliding it in a direction parallel to the second direction of parallelism or by simply lifting and replacing it at any desired position on the second surface. The drawing implement may thus be used as a T-square as used in drafting or as a parallel rule such as used in navigation. When work on the drawing or a chart is completed, the supporting device may simply be rolled up and stored conveniently for future use.

DESCRIPTION OF THE PREFERRED EMBODIMENT

FIG. 1

Figure 1:
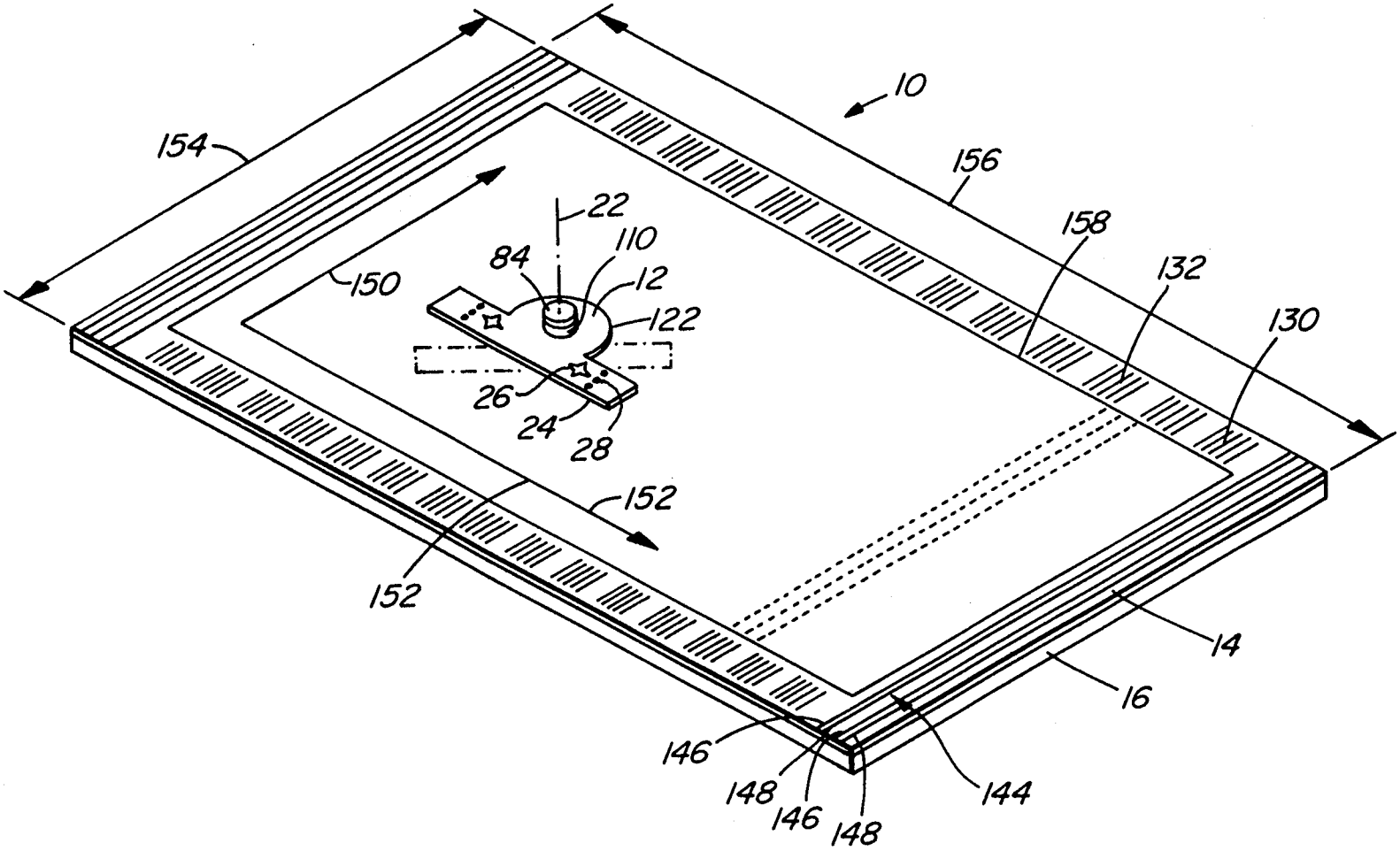
FIG. 1 is a simplified perspective view of an apparatus according to the invention.

Referring to FIG. 1, an apparatus according to the invention is shown generally at 10. The apparatus comprises a drawing implement 12 and a drawing pad 14. The drawing pad is shown placed on top of a conventional drafting board 16.

FIG. 2

Figure 2:
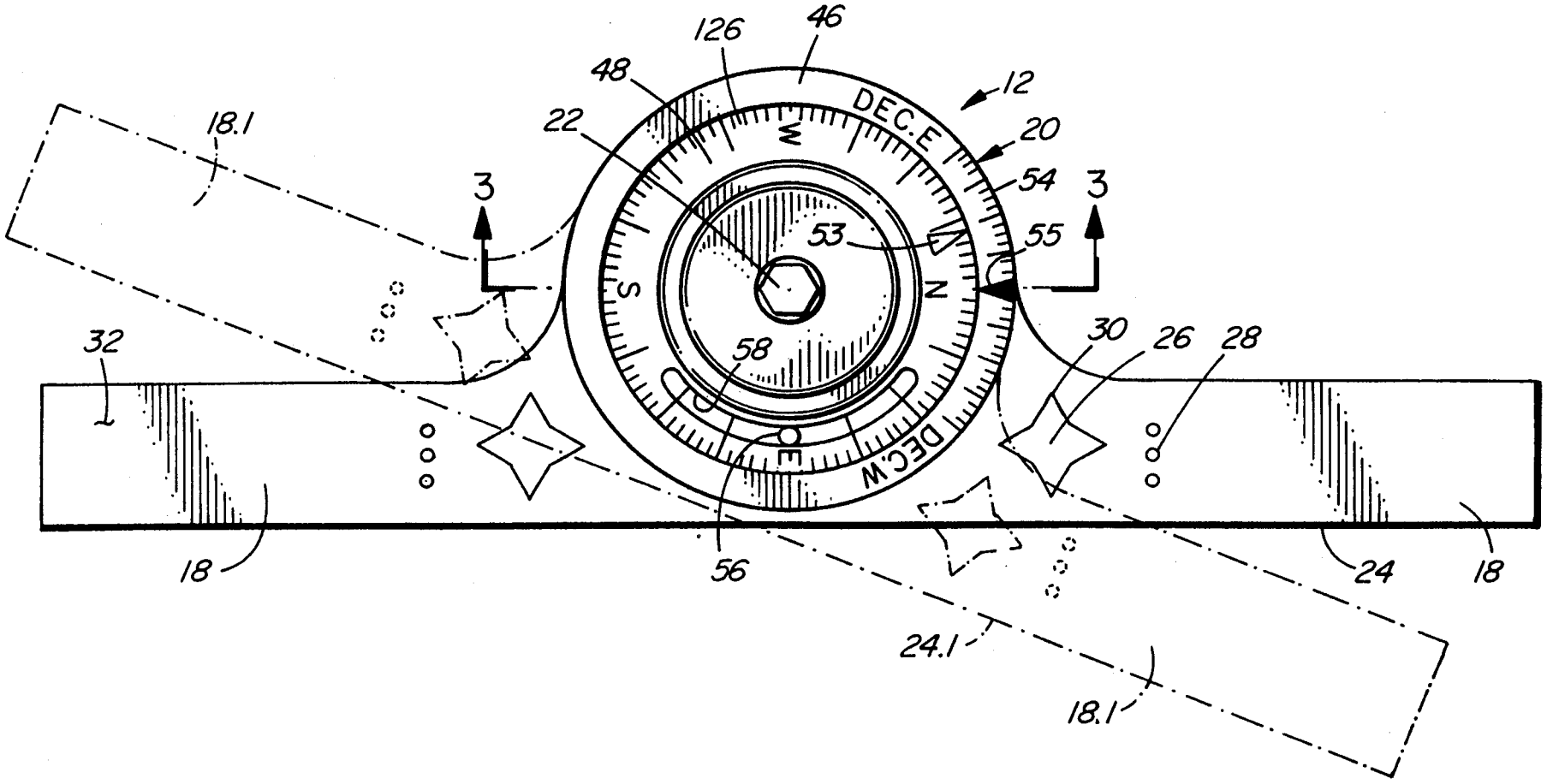
FIG. 2 is a simplified plan view of a drawing implement according to the first embodiment of the invention.

Referring to FIG. 2, the drawing implement 12 includes two rule portions 18 and a central portion 20, the central portion projecting outwardly and being disposed centrally of the rule portions.

The rule portions 18 are aligned and integral with each other, and disposed symmetrically about an axis 22 of the drawing implement 12 and together provide a straight datum edge 24 extending the length of the drawing implement. The portions 18 and 20 are made of rigid transparent plastic material having sufficient rigidity to prevent deflection when a pencil line is drawn adjacent the datum edge or when a second drawing implement such as a set square is placed against the datum edge.

Each of the rule portions 18 has a pencil guide star 26 and pencil guide holes 28. The pencil guide star has four apex portions 30 which are operable to receive and hold a drawing tip of a pencil or pen etc. The operation of the pencil guide stars and pencil guide holes will be further explained below.

FIGS. 2 AND 3

Figure 3:
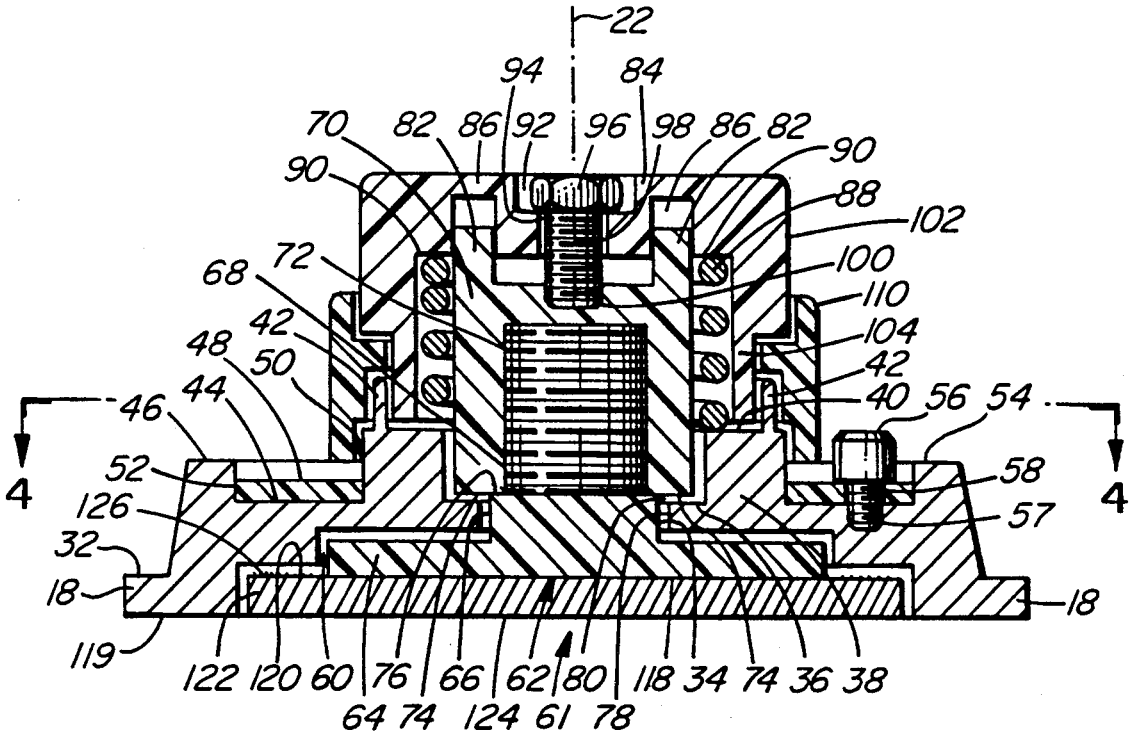
FIG. 3 is a simplified fragmented cross-sectional view of the drawing implement of FIG. 2 taken along line 3—3.
Figure 4:
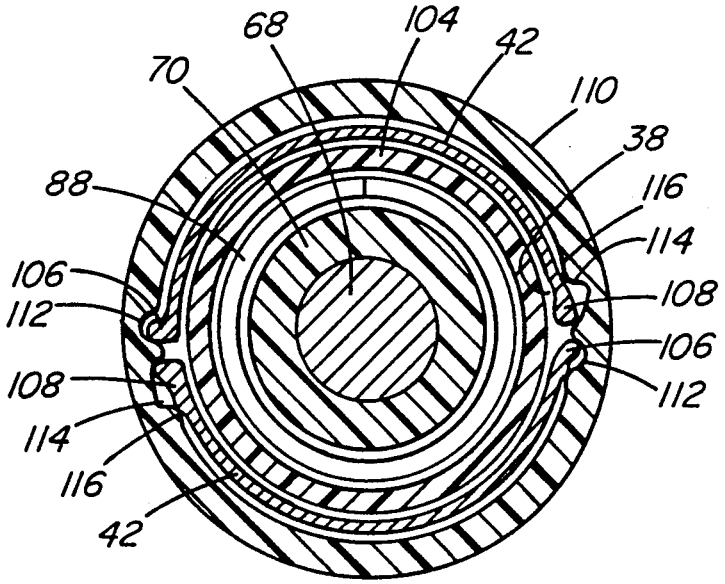
FIG. 4 is a simplified cross-sectional view of the drawing implement taken along line 4—4 of FIG. 3, some clearances being exaggerated.

Referring to FIG. 3, the central portion 20 of the drawing implement 12 is shown in cross-section. The central portion extends normally from a top surface 32 of the rule portion 18 and has a circular opening 34 having an axis coincident with the axis 22 of the drawing implement. An annular ledge portion 36 encircles the circular opening and is disposed immediately adjacent the opening. A collar portion 38 extends upwardly from and encircles the annular ledge portion 36. The collar portion 38 has an annular flat surface 40 and two annular clutch segments 42 of a clutch means (best seen in FIGS. 4 and 5) disposed adjacent the annular flat surface. A separate locking ring 110 encircles the annular clutch segments 42 and is a portion of a locking means as will be described in FIGS. 4 and 5. The central portion 20 further includes a flat annular portion 44 disposed adjacent the collar portion and an outer annular portion 46 encircling the entire central portion and disposed between the flat annular portion and the rule portions 18.

The central portion 20 of the drawing implement further includes a journalled transparent magnetic variation or declination disk 48 having an opening 50 for receiving the collar portion 38 therethrough. The disk has an outer perimeter 52 and a radially aligned reference mark 53 best seen in FIG. 3 adjacent the outer perimeter 52 which sweeps past the outer portion 46 as the disc 48 rotates. The outer portion 46 of the portion 20 has an angular graduation segment 54 imprinted thereon which extends on each side of a zero datum 55 an amount sufficient to accommodate maximum magnetic variation. The segment 54 provides a short magnetic variation protractor with sufficient angular variation East and West of North which, in combination with the mark 53 and the disc 54, permits automatic accommodation .of magnetic declination or variation between True North and Magnetic North as will be described. The magnetic variation disk 48 has an arcuate shaped opening 58, shown best in FIG. 2, through which a thumbscrew 56 is received, the thumbscrew being engagable with a complementary threaded opening 57 of the flat annular portion 44 disposed therebeneath. The thumbscrew 56 and arcuate shaped opening 58 enable a person to rotate the magnetic variation disk 48 relative to the central portion 20 to indicate the magnetic variation of True North from Magnetic North at a particular location on a chart. The thumbscrew may be tightened to secure the magnetic variation disk against rotation. In FIG. 2, the mark 53 on the disk 48 is shown set to accommodate a declination of about 22 degrees.

Referring back to FIG. 3, the central portion 20 further includes a tiered cavity 60 in communication with the circular opening 34 and disposed in an underside of the drawing implement 12. A body 61 having a disk mounting member 62 is received within the tiered cavity. The disk mounting member has a disk portion 64, a shank portion 66, and a first threaded portion 68. The shank portion 66 is received within the circular opening 34 and the first threaded portion 68 extends upwardly and has an axis coincident with the axis 22 of the drawing implement.

The body 61 further includes a cylindrical bushing 70 having a complementary first threaded portion 72 screwed onto the first threaded portion 68. The cylindrical bushing is screwed onto the threaded portion until an end portion 74 thereof abuts against an end portion 76 of the shank portion 66. The cylindrical bushing thus secures the disk mounting member 62 within the circular opening 34. The cylindrical bushing and disk mounting member thus act as connecting means for connecting the body to the rule portions.

The shank portion 66 is slightly longer than depth of an adjacent wall portion 78 of the circular opening, thus leaving a space 80 between the annular ledge portion 36 and the end portion 74 of the cylindrical bushing 70. This provides clearance and allows the central portion 20 to rotate about the axis 22 relative to the disk mounting member 62. The circular opening and shank portion thus act as swivelling means for swivelling the rule portions relative to the body.

The cylindrical bushing 70 has integral keying pins 82 which extend upwardly in a direction parallel with the axis 22. A cylindrical knob 84 having keyways 86 is fitted over the cylindrical bushing, the keying pins 82 being received within the keyways 86. A compressible coil spring 88 circumferentially embraces the cylindrical bushing and rests upon the annular flat surface 40 of the central portion 20. The spring 88 also acts upon an inner surface 90 of the cylindrical knob 84 and prevents the keying pins 82 from being completely inserted in the keyways 86, and instead the keying pins project only partially into the keyways. This allows the knob to be pressed downwardly against the spring 88 to temporarily lock the central portion against rotation relative to the disk mounting member 62 as to be more fully explained below.

The cylindrical knob 84 has a recess 92 and a top opening 94 for receiving a bolt 96 therethrough. The bolt has a second threaded portion 98 which is received within a complementary second threaded portion 100 of the cylindrical bushing 70. The bolt 96 prevents the spring from urging the knob off the cylindrical bushing.

The knob has a generally cylindrical grippable portion 102, and a concentric narrower neck portion 104 which extends below the grippable portion, between the spring 88 and the annular clutch segments 42 of the collar portion 38. When the grippable portion is pressed downwardly against the action of the spring, the neck portion 104 abuts the annular flat surface 40 of the central portion and resists rotation of the central portion relative to the knob and disk mounting member 62. Thus a downward action on the knob temporarily locks the body to the knob for added convenience without removing fingers from the knob, but this aspect is not essential to the invention. When the grippable portion 102 is released, the neck portion 104 is lifted by the spring 88 away from the annular flat surface thereby freeing the central portion for rotation about the disk mounting member.

FIG. 4

The locking means also comprises the two annular clutch segments 42 which each extend about the neck portion 104 in half circle segments. Each clutch segment 42 has a circular portion 106 at one end and a wedge portion 108 at an opposite end. Portions of the clutch segments 42 disposed intermediately of the portions 106 and 108 are connected directly to, i.e. integral with, the collar portion 38, whereas the portions 106 and 108 are separated therefrom from movement relative thereto. The segments are disposed around the neck portion 104 such that the circular portion of one segment is immediately adjacent the wedge portion 108 of the other segment. The circular portions 106 of the respective annular clutch segments are disposed diametrically opposite each other around the neck portion. Similarly, the wedge portions 108 are disposed diametrically opposite each other.

The locking ring 110 has two partially circular recesses 112 for receiving respective circular portions 106, and has two wedge recesses 114 for receiving respective wedge portions 108 of the annular segments, the four recesses facing inwardly. The locking ring 110 has cam portions 116 located adjacent the wedge recesses for pressing against the wedge portions 108.

FIGS. 1, 3 AND 5

Figure 5:
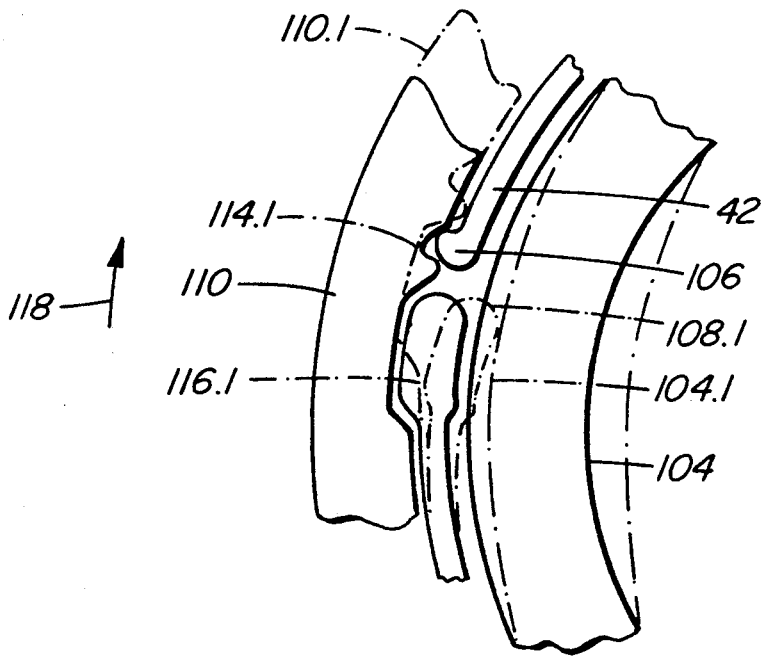
FIG. 5 is a simplified enlarged, fragmented view of a portion of FIG. 4 illustrating the cooperation of a locking ring with annular clutch segments according to the first embodiment of the invention, some clearances being exaggerated.

Referring to FIG. 5, the locking ring 110 has been rotated in direction of an arrow 118 about the axis 22 (not shown in FIG. 5) to attain the position shown in broken outline at 110.1. In this position, a circular portion 106 of one of the annular clutch segments 42 is received within a wedge recess 114.1 of the locking ring 110.1, and the adjacent cam portion 116.1 tightly abuts the adjacent wedge portion 108.1 of the opposite annular clutch segment. This results in the wedge portion 108.1 being forced inwardly against the neck portion 104.1 of the cylindrical knob, thereby preventing the central portion from rotation relative to the cylindrical knob. This provides a more permanent (but releasable) locking means, which locks the knob to the body even when the knob is released. These particular portions of the locking means bear a resemblance to a prior art locking means of a drafting instrument known to the inventor.

Referring to FIG. 3, the keying pins 82 of the cylindrical bushing 70 inserted in the keyways 86 of the cylindrical knob prevent rotation of the disk mounting member 62 relative to the knob. Consequently, as the central portion is prevented from rotation relative to the cylindrical knob, it is also prevented from rotation relative to the disk mounting member. Thus the complete implement becomes locked against rotation, and so the locking ring 110 and associated structure of the clutch segments etc. serve as the locking means for locking the rule portion to the body to prevent relative rotation therebetween. Referring to FIG. 5, the locking ring 110 may be rotated in a reverse direction to attain the position shown in solid outline, thereby freeing the projections of the annular clutch segments 42 and permitting free rotation of the central portion relative to the disk mounting member. Thus, the locking means includes the locking ring 110 mounted for rotation relative to the body, and the clutch means responsive to rotation of the locking ring. The locking ring cooperates with the body and rule portions so that rotation of the ring in one direction locks the rule portions to the body at a desired angular relationship, and rotation of the ring in the opposite direction frees the rule portions and the body to permit relative rotation therebetween. It can be seen that the clutch means has moveable follower portions, namely the wedge portions 108, which move between engaged and disengaged positions. Clearly, the wedge recesses 114 receive the moveable portions of the clutch means, and the cam portions 116 cooperate with the moveable portions to move the moveable portions between the engaged and disengaged positions, which reflect the locked position and free positions respectively of the locking means.

Referring back to FIG. 3, the disk portion 64 of the disk mounting member 62 has a flat bottom surface 118. A first magnetic sheet 122 having a bottom planar first surface 124 and a flat top surface 120 is secured to the flat bottom surface 118 such that the first surface 124 is generally co-planar with a bottom surface 119 of the rule portions 18. The flat top surface 120 has main angular protractor indicia shown best in FIG. 2, 126 arranged as a compass 'rose' with the four main points of the compass, i.e. N, S, E and W and graduations representing zero to 360 degrees of rotation. The north/south line of the compass is aligned specifically in a direction as will be described with reference to FIG. 7. When viewed from above, as illustrated in FIG. 2, the main protractor indicia 126 can be seen through the transparent portion 20 and appear to be disposed inwardly, adjacent and concentric with the angular graduation segment 54 on the portion 20. The reference mark 53 of the disc 48 is positioned directly above the indicia 126 and thus sweeps both the magnetic declination graduations of the segment 54 as well as the main protractor indicia 126. When the disc 48 is locked to the central portion 20 with the screw 56, the reference mark 53 rotates as the central portion is rotated and sweeps the main indicia 126. Thus, rotation of the central portion may be measured by comparing initial and final positions of the reference mark 53 relative to the main protractor indicia 126.

Referring back to FIG. 1, the drawing pad 14 includes a second magnetic sheet 130 having a planar second surface 132. The first and second magnetic sheets 122 and 130 are similar with the exception that in the embodiment illustrated, the first magnetic sheet 122, as illustrated in FIG. 3, has a relatively small disk shape whereas the second magnetic sheet 130, as illustrated in FIG. 1, has a rectangular shape. Other shapes could be used without departing from the invention. Magnetic sheeting suitable for use as the first and second magnetic sheets is commercially obtainable under the name ULTRA-MAG sheeting and is available from Magnets Inc. of Cincinnati, Ohio. (ULTRA-MAG is a trademark of Magnets Inc.). This sheeting is normally used in graphic display applications, for example as a backing sheet for bulletin boards and permits pieces of ferrous material to secure paper to the sheet by simple magnetic attraction which extends over the whole sheet. Typically, such sheeting has a magnetic pull or holding power of between 60 and 85 pounds per square foot (about 290 $Kg/m^2$ to 410 $Kg/m^2$).

FIG. 6

Figure 6:
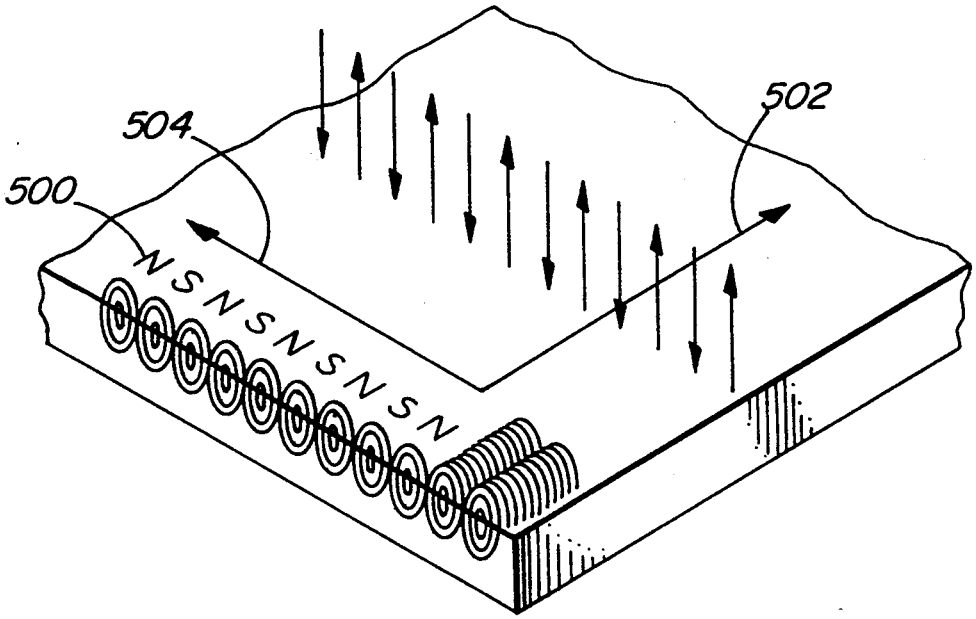
FIG. 6 is a simplified, fragmented diagram of a sheet of magnetic material used in the invention illustrating some magnetic fields.

Referring to FIG. 6, the ULTRA-MAG sheeting is a magnetically retentive material having a pre-magnetized series 500 of juxtaposed parallel linear magnetic poles of opposing polarity. The poles extend in a direction of parallelism 502 which preferably extends substantially the length of the sheet. Dissimilar adjacent poles are spaced laterally apart from each other on the same surface of the sheet in a direction 504 normal to the direction of parallelism, i.e. laterally across the width of the sheet. The number of poles appearing along a one-inch line in the normal direction is referred to as the magnetic pole resolution. In the preferred embodiment, both the first and second magnetic sheets have a magnetic pole resolution of 12.5 poles per inch. The finer the resolution of the magnetic poles, the greater the resolution of the alignment of the drawing implement 12 on the pad 14 as to be more fully described below. The approximate shapes and locations of some resulting linear magnetic fields both inside and outside the sheet are shown diagrammatically. Preferably, the linear poles should be parallel to each other within close tolerances, e.g. within one degree of parallelism to each other, so as to maintain accuracy of the invention as will be described.

FIGS. 1 AND 7

Figure 7:
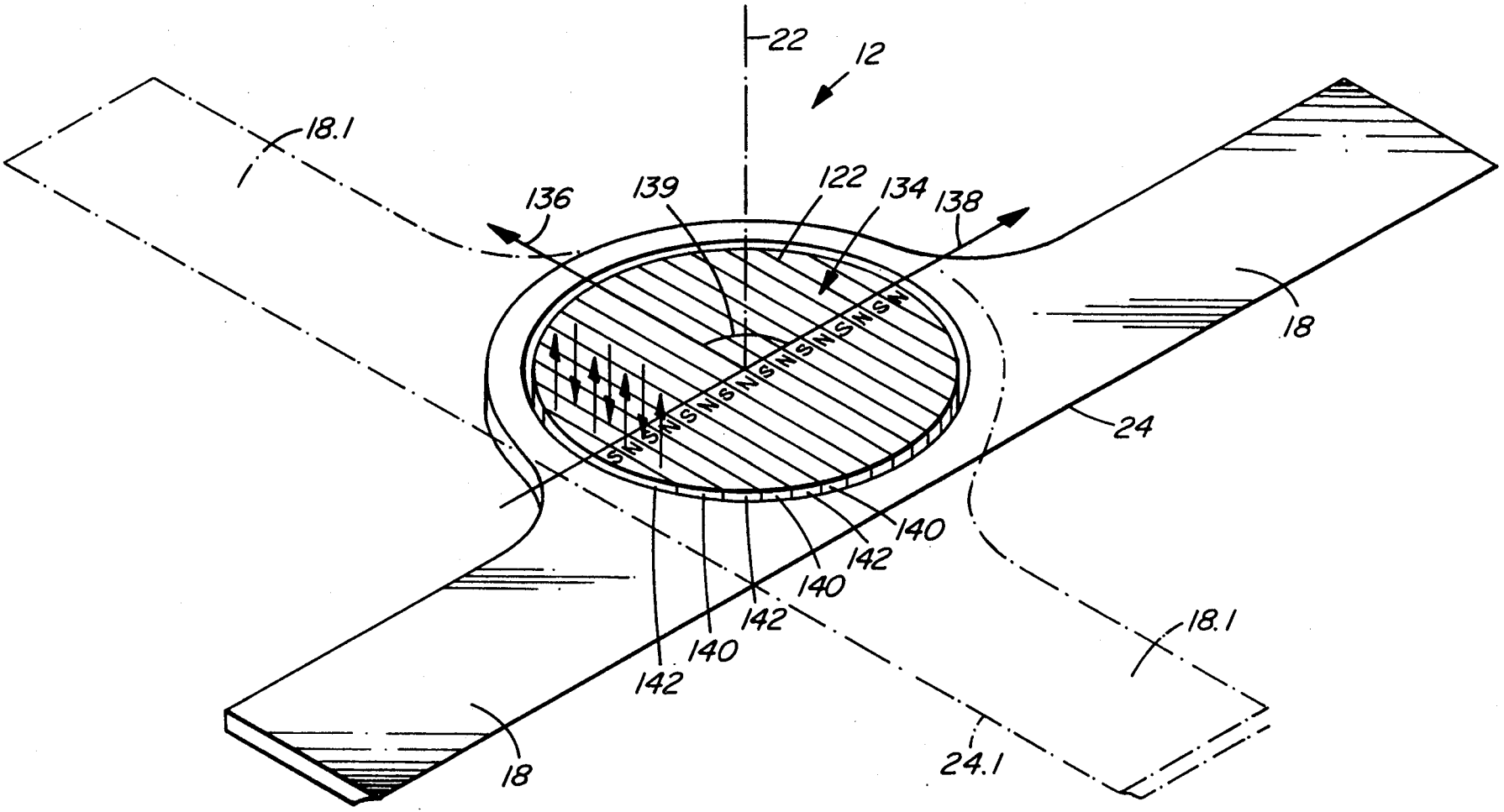
FIG. 7 is a simplified perspective view of a first sheet of magnetic material on a bottom portion of the drawing implement of FIG. 2.

Referring to FIG. 7, an underside of the drawing implement 12 is shown exposing the bottom first surface 124 of the first magnetic sheet 122. The first magnetic sheet 122 includes a disk shaped portion of ULTRA-MAG sheeting which acts as means for generating a first series 134 of juxtaposed parallel linear magnetic poles of opposing polarity. The first series includes north poles 140 and south poles 142 which are interspersed between each other, i.e. the polarity of the poles alternates with respect to distance laterally across the surface of the sheet. The poles extend linearly in a first direction of parallelism 136 with dissimilar adjacent poles being spaced apart laterally from each other in a first normal direction 138 normal to the direction of parallelism. The first magnetic sheet 122 is securely fastened to the disk mounting member 62 (not shown in FIG. 7) so that the north/south line of the main protractor indicia 126 (as seen in FIG. 2 but not shown in FIG. 7) is accurately aligned with the first direction of parallelism. This alignment is preferable but other alignments can be selected. It has been previously described that the aligned, connected rule portions 18 are rotatable about the axis 22 of the drawing implement relative to the disk mounting member. Thus, the datum edge 24 may be rotated to any position of rotation, such as the position shown in broken outline in FIG. 7, while the first magnetic sheet 122 remains in a constant position with respect to the body and indicia 126. It will thus be readily apparent that the datum edge 24 of the drawing implement may be disposed at an angle 139 relative to the first direction of parallelism 136. For example, with the drawing implement in the orientation shown in solid outline in FIG. 7, the datum edge 24 is at an angle of 90 degrees relative to the first direction of parallelism 136. Similarly, when the drawing implement is in the orientation depicted in broken outline in FIG. 7, the datum edge 24.1, on rule portions 18.1, is at an angle of 0 degrees relative to the first direction of parallelism 136. Clearly the datum edge can be oriented in any intermediate orientation, one such intermediate orientation being shown in broken outline in FIG. 2 wherein the rule portions are designated 18.1 and the datum edge is designated 24.1.

Referring back to FIG. 1, the second magnetic sheet 130 acts as second generating means for generating a second series 144 of juxtaposed linear magnetic poles of opposing polarity. The second series includes north poles 146 and south poles 148. The poles extend linearly in a second direction of parallelism 150, with dissimilar adjacent poles being spaced laterally apart from each other in a second normal direction 152 normal to the direction of parallelism 150. Lateral spacings between adjacent poles of the first and second series of magnetic poles are equal, as measured in a direction normal to the respective direction of parallelism. In the embodiment shown, the second direction of parallelism 150 is parallel to a width dimension 154 of the drawing pad 14, and the second normal direction 152 is parallel to a length dimension 156 of the drawing pad, where the width dimension is taken as a short side dimension and the length dimension is taken as a long side dimension of the drawing pad.

OPERATION

FIGS. 1, 2, 5 AND 8

Figure 8:
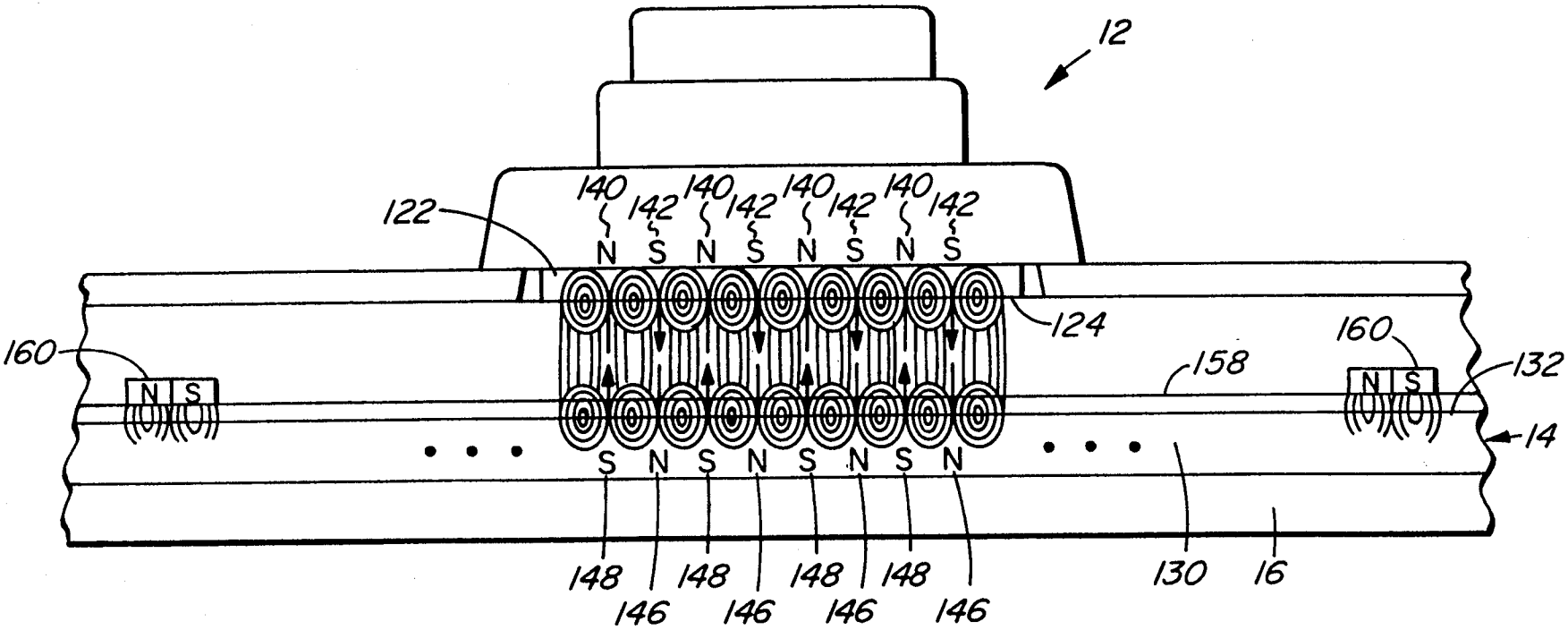
FIG. 8 is a simplified fragmented diagrammatic end view of the drawing implement positioned slightly above a second sheet of magnetic material showing magnetic fields generated by the invention.

Referring to FIG. 8, the drawing implement 12 is positioned above the drawing pad 14 including the second magnetic sheet 130 on the drafting board 16. A piece of paper 158 is placed on the second surface 132 of the second sheet. The piece of paper is secured in place by small magnets 160 which are attracted to the magnetized second sheet. Alternatively, the paper may be secured to the sheet by small pieces of adhesive tape or by small pieces of ferrous material which are attracted to the second sheet.

The first surface 124 of the drawing implement 12 is brought into close proximity with the sheet of paper 158 and hence gets nearer the second surface. As the first surface gets nearer the second surface 132, the north poles 146 of the second magnetic sheet 130 attract the south poles 142 of the first magnetic sheet 122. Similarly, the south poles 148 of the second magnetic sheet 130 attract the north poles 140 of the first magnetic sheet.

As the drawing implement 12 is placed in close proximity with the second sheet 130, there is little chance that the drawing implement will be placed by the draftsman in a position such that unlike poles of the first and second sheets are exactly aligned with each other. However, as the magnetic poles extend juxtaposed in parallel linear relation, any portions of the north poles 140 of the first sheet 122 overlapping or near portions of north poles 146 of the second sheet 130 tend to repel each other. Similarly, overlapping portions of south poles tend to repel each other.

This tendency to repel imposes forces with lateral components which act upon the overlapping portions of the first sheet and hence on the drawing implement. In addition, overlapping portions of dissimilar poles impose forces having lateral components which attract each other. These lateral components tend to push overlapping portions of similar poles away from each other and pull overlapping portions of dissimilar poles toward each other, thereby automatically aligning the drawing implement such that poles on the first sheet are rendered parallel and immediately adjacent dissimilar poles on the second sheet.

As the first sheet has the same density of poles per inch as the second sheet, i.e. lateral spacings between adjacent linear poles are equal, the north poles 140 on the first sheet 122 align with the south poles 148 on the second sheet 130, while the south poles 142 on the first sheet align with the north poles 146 on the second sheet. As the poles of the first series 134 extend in the first direction of parallelism 136, and the poles of the second series 144 extend in the second direction of parallelism 150, the drawing implement is forced by magnetic forces into a position such that the first and second directions of parallelism are parallel with each other and thereby aligned.

In FIG. 8, the first and second directions of parallelism are aligned and are normal to the plane of the paper. The drawing implement 12 is thus automatically and rapidly aligned with the width dimension 154 of the pad 14, assuming frictional forces between the two sheets are negligible. The first and second sheets 122 and 130 thus act as aligning means for aligning the drawing implement on the second surface.

As the magnetic poles extend the entire width of the second sheet 130, alignment of the drawing implement 12 on the second sheet is maintained at any position thereon. The drawing implement may thus be moved parallel to the width dimension 154 of FIG. 1 relatively easily as there is only slight frictional resistance to aligned movement. The drawing implement may not be moved easily in any direction having a displacement component normal to the first direction of parallelism as repulsive forces of similar poles and attractive forces of dissimilar poles on the first and second sheets oppose any such movement, or relative skewing of the first and second sheets.

Referring to FIGS. 1 and 5, with the drawing implement 12 placed on the drawing paper 158, the first sheet 122 on the drawing implement is securely held and supported by the second surface 132. The second surface thus acts as supporting means for supporting the drawing implement. With the drawing implement on the second surface, the locking ring 110 may be moved to the position shown in solid outline in FIG. 5, thereby releasing the wedge portions 108 of the annular clutch segments 42 away from the neck portion 104 of the cylindrical knob 84. This enables the rule portions 18 and the datum edge 24 to be rotated by moving the rule portion relative to the axis 22 of the drawing implement to the position shown in broken outline in FIG. 1. It will be appreciated that, if desired, the rule portions 18 and hence the datum edge 24 may be rotated through a full 360 degrees relative to the cylindrical knob.

When the rule portions 18 and the datum edge 24 are rotated to the desired angle of inclination, the locking ring 110 is rotated to the position shown in broken outline in FIG. 5. This locks the wedge portions 108.1 of the annular clutch segments against the neck portion 104.1 of the knob, hence locking the rule portion against rotation relative to the disk mounting member 62. Thus, if the angle of rotation of the rule portion relative to the knob represents a course heading on a chart, and if it is desired to transfer the course heading to another portion of the chart, the drawing implement 12 may then simply be lifted from the second surface 132 and placed in any desired section of the chart.

As the angle of the datum edge 24 relative to the first direction of parallelism 136 is maintained constant by the locking ring 110, placement of the drawing implement elsewhere on the second surface 132, aligns the drawing implement such that the first and second directions of parallelism are parallel, and thus the orientation of the drawing implement in the first position is re-established in the second position. In this manner, a bearing or course heading may be transferred from one position on the chart to another and thus the apparatus 10 can be used as a substitute for conventional parallel rulers such as for plotting courses on nautical charts.

The pole resolution (i.e. lateral spacing of the poles) of the first and second sheets limits the placement of the drawing implement 12 on the second surface 132 to discrete, spaced apart locations along the length dimension 156 of the second sheet. If the rule portions 18 are rotated such that the datum edge 24 is parallel with the first and second directions of parallelism, it will be appreciated that the datum edge may also only be placed in certain discrete, spaced apart locations on the second surface 132. Thus, the datum edge 24 is prevented from being placed in intermediate positions between the poles. To overcome this problem, the pencil guide stars 26 and pencil guide holes 28 are used.

To draw a line parallel to the second direction of parallelism in an intermediate position, the locking ring 110 may be released and the rule portions 18 may be rotated relative to the first surface 124 until one of the pencil guide stars 26 or one of the pencil guide holes 28 is positioned directly over the position on which the desired line is to be drawn. If the pencil guide star 26 is used, a drawing tip, e.g. a pencil point or nib, is lodged within the appropriate apex portion of the pencil guide star 26, and the drawing implement is moved in a direction parallel to the width dimension 154 of the second surface 132, thereby moving the drawing tip across the drawing or chart parallel to the magnetic poles. Alternatively, the drawing tip may be placed in one of the pencil guide holes 28 and a similar operation performed.

The following describes a navigation bearing procedure with automatic accommodation for magnetic declination or variation which is found on most locations on Earth. A normal scale rectangular marine navigation chart has lines of latitude and longitude, and also a compass rose which indicates the amount of magnetic declination or variation applicable to the area depicted by the chart. The chart is set squarely on the pad 14 so that the second direction of parallelism of the pad is parallel to the lines of longitude, i.e. parallel to the vertical edges of the chart, which are aligned with True North. Magnetic variation corresponds to the difference in bearing between True North and Magnetic North. For instance, the magnetic variation in British Columbia is 22.5 degrees East of North. Consequently, Magnetic North is not parallel with the lines of longitude and, thus is not parallel with the second direction of parallelism in the magnetic sheet or pad 14. Therefore, the angle of the reference mark 53 relative to the datum edge 24 of the rule portion 18 is appropriately adjusted by rotating the variation disk 48 on which the reference mark 53 is inscribed. The thumbscrew 56 is loosened and the disk turned 22.5 "East" as indicated on the graduated scale 54 and as shown in FIG. 2. The direction of declination "East", on the scale 54 (DEC.E) is opposite to East on the compass rose to provide the compensation. Thus, a magnetic bearing is dialed into the instrument by rotating the body carrying the main protractor indicia 126 so that the desired bearing appears under the mark 53. Thus the datum edge 24 of the rule portion will be compensated the requisite amount of magnetic variation so as to indicate the bearing accurately on the chart. The locking ring 110 may then be tightened, if desired, to retain the bearing without risk of slippage, or alternatively the bearing can be "held temporarily" by merely pressing down on the knob 84.

When using a rectangular strip chart, True North is usually not aligned with vertical edges of the chart. Consequently, when a strip chart is placed squarely on the pad 14, the second direction of parallelism of the pad is not aligned with True North. For setting the instrument to a particular magnetic bearing, the instrument is placed near a compass rose inscribed on the chart and the datum edge 24 is aligned with Magnetic North indicator on the rose. The disk 48 is turned to place the reference mark 53 over the North position on the main protractor indicia 126. The thumbscrew 56 is retightened and now all magnetic bearings when dialed in under the reference mark will be reflected accurately by the rule portion.

Thus, it can be seen that the apparatus includes a main angular protractor graduated scale means 126 and a complementary reference mark 53, both of which cooperate with the body and rule portions as required to determine an angular relationship between the datum edge of the rule portion and the first direction of parallelism relating to the body. The main angular protractor scale means 126 is mounted on the body concentrically with respect to the axis at the swiveling means, and is fixed with respect to the first direction of parallelism. Clearly, the reference mark 53 is located on the disk 48 which is rotatable relative to the rule portion and lockable relative thereto to reflect local magnetic variation at a particular location. The apparatus further includes a magnetic variation protractor or graduated scale means 54 cooperating with the main angular protractor graduated scale means 126 and the reference mark to provide a means of accommodating for the angular variation between True North and Magnetic North at a particular location. In this embodiment it can be seen that the magnetic variation scale means or protractor segment 54 is located on the central portion 20 concentrically with respect to the main angular graduated scale means 126. As will be described, alternative locations of the main protractor scale, the magnetic variation scale and the reference mark are available.

ALTERNATIVES

The implement 10 as described can be simplified by eliminating the temporary locking aspect relating to depressing the knob 84. Referring to FIG. 3, the cylindrical bushing 70 is made integral with the knob 84, and is permanently screwed onto the threaded portion 72 of the body, thus eliminating the spring 88. Thus the knob is a rigid portion of the body.

Also, the magnetic variation structure can be inverted so that an alternative adjustable reference mark can be substituted for the main protractor indicia 126 on the top surface 120 of the base, and instead the main protractor indicia are inscribed on the outer annular portion 46 of the central portion 20. This would then bear a resemblance to a SILVA (TM) RANGER COMPASS (TYPE 15) as manufactured by SILVA of Sweden.

The embodiment above has been described particularly for use as a navigation instrument, for example as a substitution for parallel rulers and other plotting instruments. Consequently, a compass rose and magnetic variation compensation means are provided. Clearly, if the device were to be used in engineering or architectural drafting, the compass rose and magnetic variation compensation structure would not be required. Instead, the main angular protractor graduated scale means would be provided with a conventional protractor covering 360 degrees of arc, with, if necessary, specifically identified common quadrants, such as 30 degree, 60 degrees, 90 degrees, etc. identified on the protractor scale as is common practice.

FIGS. 9 AND 10

Figure 9:
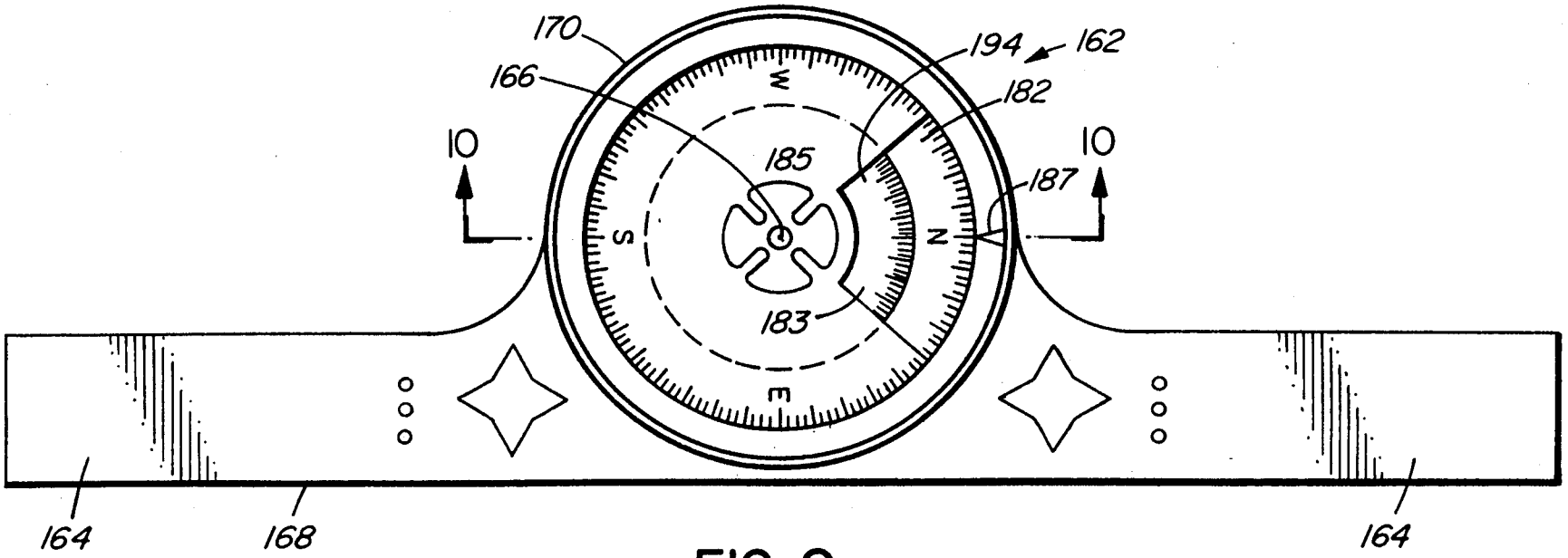
FIG. 9 is a simplified plan view of a drawing implement according to an alternative embodiment of the invention.

Referring to FIG. 9, a simplified, less costly drawing implement according to an alternative embodiment of the invention is shown generally at 162. The drawing implement includes rule portions 164 disposed symmetrically about an axis 166 of the drawing implement, and has a datum edge 168 extending the length of the drawing implement. A central portion 170 . projects outwardly and is disposed centrally of the rule portions, the rule portions and central portion preferably being integral with each other and fabricated from a transparent material to permit viewing therethrough as previously described.

Figure 10:
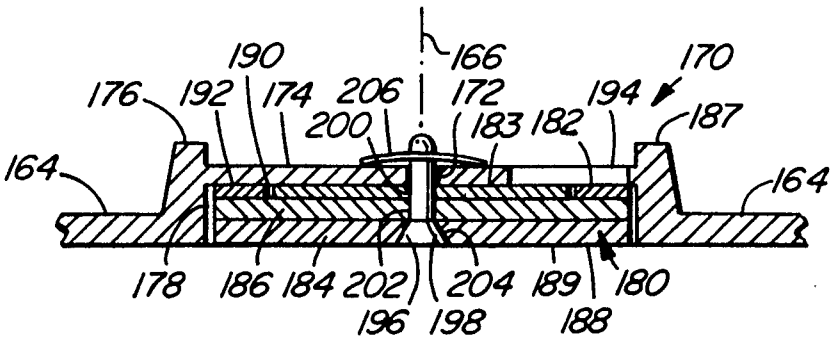
FIG. 10 is a simplified cross section of the drawing implement taken along line 10—10 of FIG. 9.

Referring to FIG. 10, the central portion 170 of the drawing implement is shown in cross-section. The central portion has a circular opening 172 having an axis coincident with the axis 166 of the drawing implement. A flat disk portion 174 encircles the circular opening and is disposed immediately adjacent the opening. A raised annular portion 176 encircles the entire central portion an is disposed between the flat disk portion 174 and the rule portions 164. The central portion further includes a cylindrical cavity 178 in communication with the circular opening 172 and disposed in an underside of the drawing implement.

A body 180, a main angular protractor 182 and a magnetic variation protractor 183 are received within the cylindrical cavity. The main protractor 182 is an annular sheet member carrying graduated scale means including a compass rose with conventional 360 degrees of graduations and main compass markings. The main protractor 182 has a concentric central opening which receives the magnetic variation protractor 183 therein. The protractor 183 is a sheet member of similar thickness as the protractor 182 and carries an angular graduation segment sufficient to accommodate magnetic variation or declination as previously described. The body 180 has first and second disk portions 184 and 186 which are formed from first and second disk portions of the ULTRA-MAG magnetic sheeting material described in connection with FIG. 6. The first and second disk portions are secured together such that a magnetised surface 188 of the first disk forms a bottom portion 189 of the body while a magnetised surface 190 of the second disk forms a top portion 192 of the body. The main protractor 182 is of a magnetically attractable material such as steel and is held on the top portion 192 of the body by the magnetised surface 190 of the second disk portion 186. The second disk portion 186 merely serves as a means to releasably secure the protractor 182 to the body. In contrast, the magnetic variation protractor 183 is secured permanently to the surface 192 and thus is locked relative to a first direction of parallelism of the linear magnetic fields of the first disc portion 184 as will be described. The protractor 183 has a zero datum mid position 185, best seen in FIG. 9, and the central portion 170 has a reference mark 187 which sweeps the protractor 182 as the central portion and rule portions are rotated relative to the body 180.

The flat disc portion 174 of the central portion 170 has an arcuate-shaped opening 194, best seen in FIG. 9, which permits a person's finger or other instrument to pass through the portion 174 to contact the main protractor 182 to rotate the protractor 182 relative to the body, so as to accommodate magnetic variation or declination as will be described. Thus, the main protractor 182 having the compass rose can be shifted relative to the first direction of parallelism in contrast to adjustment previously described with reference to FIGS. 1 through 8. Thus, in the alternative embodiment, the main angular protractor 182 is mounted on the body concentrically with an axis of the swivelling means, the protractor being adjustable angularly relative to the body means and releasably securable thereto. The magnetic variation protractor is secured to the body concentrically with respect to the axis of the swivelling means, and is fixed relative to the first direction of parallelism. The reference mark 187 is located with respect to the rule portions and cooperates with the scale on the main protractor 182.

Referring back to FIG. 10, the body 180 is secured to the central portion 162 by a rivet 196 having a countersunk head 198 and a shank portion 200. The rivet is inserted through aligned openings 202 in the body 180 and in the magnetic variation disk 183 and through the circular opening 172 in the central portion. The countersunk head 198 is received within a countersunk hole 204 of the body such that the head 198 is flush with or recessed within the bottom portion 189 of the body. Thus, the bottom portion of the body has a flat surface with no protrusions. The shank portion 200 of the rivet extends upwardly of the flat disk portion 174 and a locking spring washer 206 is used to secure the rivet in place.

The bottom portion 189 of the body has a series of juxtaposed parallel linear magnetic poles of opposing polarity similar to the first magnetic sheet 122 described previously. Referring to FIG. 9, the body has the first direction of parallelism also similar to that described previously which is aligned with the axis 166 and the zero datum position 185 of the magnetic variation protractor or disk 183.

In operation, when the apparatus of FIGS. 9 and 10 is placed on the drawing pad 14, the body 180 is aligned such that the first direction of parallelism of the body is parallel to the second direction of parallelism on the pad. The magnetic attraction between the bottom portion 189 of the body and the second surface 132 retains the body in alignment and securely on the second surface 132. The body is thus prevented from rotation or non-aligned movement.

The central portion 170 and hence the rule portions 164 are rotatable about the rivet 196 relative to the body 180 to provide a swivelling means as previously described in the first embodiment. However, it will be appreciated that this embodiment has no positive locking means as in the first embodiment, but instead relies on friction between the body 180 and the central portion 170 to resist relative rotation. Thus, a hand of the draftsman may be used to securely hold the drawing implement in place during use. Operation of the device of the second embodiment is therefore similar to the operation of the first embodiment with the exception that the second embodiment has no positive locking means, and the compass rose or main protractor 182 is held in place by magnetic attraction of the disk 182 to the top portion 192 of the body.

To compensate for magnetic variations, the disk 182 may be moved relative to the body by inserting a finger through the arcuate opening 194 to hold the disk while reaching under the drawing implement to rotate the body 180 relative to the disk. Alternatively, when the drawing implement is on the second surface, a finger may be inserted through the arcuate opening 194 to rotate the disk 182 relative to the body, while the attraction forces between the bottom portion 189 of the body and the second surface hold the body in place.

One possible type of magnetic sheeting has been described as being practical for use in forming the first and second magnetic sheets. In particular, this preferred type of sheeting has a first series of juxtaposed parallel linear magnetic poles, the poles extending linearly in a first direction of parallelism. Adjacent poles of the surface are of opposite polarity and are spaced apart laterally from each other in a direction normal to the direction of parallelism. It is conceivable that other types of magnetic sheeting having different linear pole arrangements could be employed.

While specific embodiments of the invention have been disclosed, such embodiments should be considered illustrative of the invention only and not as limiting the invention as construed in accordance with the accompanying claims.

I claim:

1. An apparatus comprising:

(a) a drawing implement having
  a body having a flat first surface lying fixed in a plane,
  a rule portion having a datum edge lying in said plane; and
  connecting means for pivotally connecting the body to the rule portion to permit selective free rotation between the rule portion and the first surface about an axis perpendicular to said plane;

(b) supporting means having a second surface for supporting said drawing implement;

(c) aligning and securing means for aligning and securing said drawing implement on said second surface, the aligning means including;
  (i) first generating means for generating a first series of juxtaposed parallel linear magnetic poles in the first surface, the poles of the first series extending linearly across the first surface in a first direction of parallelism, adjacent poles being spaced apart laterally from each other in a first normal direction normal to the first direction of parallelism, the datum edge being disposed at an angle relative to the first direction of parallelism, the first surface supporting the body on the second surface and having sufficient area to secure the implement to the second surface; and,
  (ii) second generating means for generating a second series of juxtaposed parallel linear magnetic poles in the second surface, the poles of the second series extending linearly in a second direction of parallelism, adjacent poles of the second series being spaced apart laterally from each other in a second normal direction normal to the second direction of parallelism, the poles in the first surface being attracted to poles of the second surface with sufficient force to maintain said drawing implement on said second surface, and to permit mutual alignment of the linear magnetic poles of the first and second generating means.

2. An apparatus as claimed in claim 1, wherein:

(a) the first series includes poles of north polarity and poles of south polarity disposed so that the dissimilar poles are adjacent each other, and (b) the second series includes poles of north polarity and poles of south polarity disposed so that dissimilar poles are adjacent each other.

3. An apparatus as claimed in claim 1, wherein the connecting means further includes:

(a) swivelling means for swivelling the rule portion relative to the body so as to vary the angle between the datum edge and the first direction of parallelism, the swivelling means cooperating with the rule portion and the body.

4. An apparatus as claimed in claim 3, wherein the drawing implement further includes:

(a) locking means for locking the rule portion relative to the body to prevent relative rotation therebetween so that the datum edge is inclined at a fixed angle relative to the first direction of parallelism.

5. An apparatus as claimed in claim 1, wherein:

(a) the first generating means includes a first magnetic sheet of magnetically retentive material, the sheet being pre-magnetised with the first series of magnetic poles, (b) the second generating means includes a second magnetic sheet of magnetically retentive material, the second sheet being pre-magnetised with the second series of magnetic poles.

6. An apparatus as claimed in claim 1, further including:

(a) a main angular graduated scale means and a complementary reference mark, the scale means and reference mark cooperating with the body and rule portion as required to determine an angular relationship between the datum edge of the rule portions and the first direction of parallelism relating to the body.

7. A plotting and drafting apparatus having a drawing implement comprising:

(a) a rule portion having a datum edge lying in a plane;

(b) aligning and securing means for aligning and securing the apparatus to a cooperating surface, the means including;
  (i) a body having a flat first surface lying fixed in said plane, the first surface providing means for supporting the implement on the cooperating surface; and
  (ii) first generating means for generating a first series of juxtaposed parallel linear magnetic poles in the first surface, the poles of the first series extending linearly across the first surface in a first direction of parallelism, adjacent poles being spaced apart laterally from each other in a first normal direction normal to the direction of parallelism, the first surface having sufficient area to secure the implement to the cooperating surface; and (c) connecting means for pivotally connecting the body to the rule portion to permit selective free rotation between the rule portion and the first surface of the body, said rotation being about an axis perpendicular to said plane.

8. An apparatus as claimed in claim 7 wherein the connecting means further includes:

(a) swivelling means for swivelling the rule portion relative to the body so as to vary the angle between the datum edge and the first direction of parallelism, the swivelling means cooperating with the rule portion and the body.

9. An apparatus as claimed in claim 8, further including:

(a) a main angular protractor graduated scale means and complementary reference mark, the protractor scale means and reference mark cooperating with the body and rule portions to determine an angular relationship between the datum edge of the rule portion and the first direction of parallelism relating to the body.

10. An apparatus as claimed in claim 9, further including:

(a) a magnetic variation graduated scale means cooperating with the main angular protractor graduated scale means and the reference mark to provide a means of compensating for the angular variation between True North and Magnetic North at a particular location.

11. An apparatus as claimed in claim 10, in which:

(a) the main angular graduated scale means is mounted on the body concentrically with an axis of the swivelling means, the scale means being adjustable angularly relative to the body means and releasably securable thereto, (b) the magnetic variation graduated scale means is secured to the body concentrically with respect to the axis of the swivelling means and is fixed with respect to the first direction of parallelism, (c) the reference mark is located on the rule portion and cooperates with the main graduated scale means.

12. An apparatus as claimed in claim 10, in which:

(a) the main angular protractor graduated scale means is mounted on the body concentrically with respect to an axis of the swivelling means, and is fixed with respect to the first direction of parallelism, (b) the magnetic variation graduated scale means is located on the body concentrically with respect to the main angular graduated scale means, (c) the reference mark is located on a disc which is rotatable relative to the rule portion and lockable relative thereto to reflect local magnetic variation at a particular location.

13. An apparatus as claimed in claim 8 wherein the drawing implement further includes:

(a) locking means for locking the rule portion relative to the body to prevent relative rotation therebetween so that the datum edge is inclined at a fixed angle relative to the first direction of parallelism.

14. An apparatus as claimed in claim 13, in which the locking means includes:

(a) a locking ring mounted for rotation relative to the body, (b) clutch means responsive to rotation of the locking ring and cooperating with the body and the rule portion, so that rotation of the ring in one direction locks the rule portion to the body at a desired angular relationship thereto, and rotation of the ring in the opposite direction frees the rule portion and body to permit relative rotation therebetween.

15. An apparatus as claimed in claim 14, in which:

(a) the clutch means has moveable follower portions which move between engaged and disengaged positions, (b) the locking ring has recesses to receive the moveable portions of the clutch means, the recesses having cam portions which cooperate with the moveable portions to move the moveable portions between the engaged and disengaged positions which reflect locked and free positions respectively of the locking means.

16. A plotting and drafting apparatus as claimed in claim 7 further including:

(a) supporting means having a second surface serving as the cooperating surface for supporting said body and second generating means for generating a second series of juxtaposed parallel linear magnetic poles in the second surface, the poles of the second series extending linearly in a second direction of parallelism, adjacent poles of the second series being spaced-apart laterally from each other in a second normal direction normal to the second direction of parallelism, and in which:

(b) the poles in the first and second surfaces have sufficient force to maintain said drawing implement on said second surface, and to permit mutual alignment of the linear magnetic poles of the first and second generating means.

17. An apparatus as claimed in claim 16 wherein:

(a) the first series includes poles of north polarity and poles of south polarity disposed so that dissimilar poles are adjacent each other and, (b) the second series includes poles of north polarity and poles of south polarity disposed so that dissimilar poles are adjacent each other.

18. An apparatus as claimed in claim 16 wherein:

(a) the first generating means includes a first magnetic sheet of magnetically retentive material, the sheet being pre-magnetized with the first series of magnetic poles, (b) the second generating means includes a second magnetic sheet of magnetically retentive material, the second sheet being pre-magnetized with the second series of magnetic poles.

19. An apparatus as claimed in claim 16 wherein the first and second surfaces are planar surfaces.

20. An apparatus as claimed in claim 16, wherein:

(a) lateral spacings between adjacent poles of the first and second series of magnetic poles are equal, as measured in a lateral direction normal to the respective direction of parallelism.

21. A method of securing and aligning a drawing implement to a surface, the method including the steps of:

(a) providing for said drawing implement a body with a flat first surface lying fixed in a plane, and a rule portion with a datum edge lying in said plane.

(b) pivotally connecting the body to the rule portion to permit selective free rotation between the rule portion and the first surface about an axis perpendicular to said plane, (c) supporting the body of said drawing implement on a second surface by means of the first surface, (d) generating a first series of juxtaposed parallel linear magnetic poles in the first surface, the poles of the first series extending linearly across the first surface in a first direction of parallelism, adjacent poles being spaced apart laterally from each other in a first normal direction normal to the first direction of parallelism, the datum edge being disposed at an angle relative to the first direction of parallelism, (e) generating a second series of juxtaposed parallel linear magnetic poles in the second surface, the poles of the second series extending linearly in a second direction of parallelism, adjacent poles of the second series being spaced apart laterally from each other in a second normal direction normal to the second direction of parallelism, (f) attracting the poles sin the first surface to the poles of the second surface, the first surface having sufficient area to provide sufficient force to secure the implement to the second surface, and to permit mutual alignment of the linear magnetic poles of the first and second series.

22. A method as claimed in claim 21 further including the step of;

(a) permitting said first surface to move relative to said second surface in a direction parallel to said second direction of parallelism while resisting movement of said first surface relative to said second surface in a direction perpendicular to said second direction of parallelism.

23. A method as claimed in claim 21 further including the step of locking said rule portion such that a datum edge of said rule portion is at an angle relative to said second direction of parallelism.

24. A method as claimed in claim 21 wherein the steps of generating include the steps of pre-magnetising the first and second surfaces with the first and second series of magnetic poles respectively.

* * * * *